US006242864B1

(12) United States Patent
Nakahara et al.

(10) Patent No.: US 6,242,864 B1
(45) Date of Patent: Jun. 5, 2001

(54) PLASMA DISPLAY PANEL WITH INSULATING LAYER HAVING SPECIFIC CHARACTERISTICS

(75) Inventors: Hiroyuki Nakahara; Takashi Katayama, both of Kawasaki; Kazuhide Iwasaki, Satsuma-gun; Manabu Ishimoto, Kawasaki; Nobuhiro Iwase, Kawasaki; Souichirou Hidaka, Kawasaki; Akihiro Mochizuki, Kawasaki, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 08/963,828

(22) Filed: Nov. 4, 1997

(30) Foreign Application Priority Data

May 30, 1997 (JP) ..... 9-141348

(51) Int. Cl.[7] ..... H01J 65/04
(52) U.S. Cl. ..... 315/169.3; 106/2; 313/586
(58) Field of Search ..... 315/169.4, 169.3, 315/160; 345/66, 204; 313/586; 106/2

(56) References Cited

U.S. PATENT DOCUMENTS

| | | | |
|---|---|---|---|
| 3,863,089 | 1/1975 | Ernsthausen et al. | 313/201 |
| 5,454,861 | 10/1995 | Hasegawa et al. | 106/2 |

FOREIGN PATENT DOCUMENTS

| | | |
|---|---|---|
| 5-234519 | 9/1993 | (JP) . |
| 6-316671 | 11/1994 | (JP) . |
| 7-160218 | 6/1995 | (JP) . |
| 8-111178 | 4/1996 | (JP) . |
| 8-278766 | 10/1996 | (JP) . |
| WO 9637904 | 11/1996 | (WO) . |

*Primary Examiner*—David Vu
(74) *Attorney, Agent, or Firm*—Staas & Halsey, LLP

(57) ABSTRACT

A plasma display panel of a matrix display type, having a first electrode and a second electrode which constitute a main electrode pair, the first electrode and the second electrode being covered with an insulating layer against a discharge gas, wherein the insulating layer comprises a magnesium oxide film formed at least as a surface layer thereof which is in contact with the discharge gas, the magnesium oxide film having an impedance in the range of 230 to 330 kΩ/cm$^2$ at a frequency of 100 Hz.

29 Claims, 7 Drawing Sheets

PLASMA DISPLAY PANEL WITH INSULATING LAYER HAVING SPECIFIC CHARACTERISTICS

BACKGROUND OF THE INVENTION

1. Field of the Invention

The present invention relates to a plasma display panel (PDP), especially an AC type plasma display panel operable in a matrix display system. The present invention is the plasma display panel of suitably used for a surface discharge type PDP in which discharge will occur along a screen.

2. Description of the Related Art

Recently, plasma display panels (PDPs) have been widely used in television displays as well as monitors of computers since color PDP screens could be practically available. Particularly, these PDPs may be utilized as large-screen flat type display devices for the high definition television (HDTV) system.

In matrix display type PDPs, a memory effect is utilized so as to sustain lighting conditions of cells. The AC type PDP is arranged so as to own a memory function in a structural manner by covering an electrode with a dielectric material. That is, when the AC type PDP is turned ON, lines are successively addressed in order to store wall electron charges only into cells to be lighted(emitted). Thereafter, voltages (namely sustain voltages) having alternate polarities are applied to all of these cells within one time. This sustain voltage corresponds to a predetermined voltage lower than a discharge starting voltage. In such a cell where wall electron charges are stored, since the wall voltage is superimposed with the sustain voltage, the effective voltage applied to this cell exceeds the discharge starting voltage, so that a discharge operation will occur. If the time period during which the sustain voltage is applied is shortened, then a virtually continuous lighting condition can be obtained.

In surface discharge type PDPs which are commercially available, one pair of sustain electrodes (namely, first electrode and second electrode) are arranged in parallel to each other, which extend over and entire length of the screen in a matrix display every line, whereas an address electrode (namely, third electrode) is arranged every column. An interval between sustain electrodes in the respective lines is referred to as a "discharge slit". A width of this discharge slit is selected to be such a value, for example, 50 to 100 $\mu$m that the surface discharge may occur when the effective voltage of on the order of 200 to 250 V is applied. On the other hand, another interval between sustain electrodes present in adjacent lines is referred to as a "reverse slit". A width of this reverse slit is made sufficiently larger than that of the discharge slit. That is to say, the surface discharge occurred between the sustain electrodes separated from each other via the reverse slit can be prevented. As described above, both the discharge slit and the reverse slit are provided to arrange the sustain electrodes, so that the respective lines can be selectively emitted.

A protection film having an anti-sputtering characteristic capable of mitigating an influence caused by ion bombardment occurred during discharge operation is provided on a surface of a dielectric material layer (for instance, a low melting point glass) for covering the sustain electrode. Since this protection film is made in contact with the discharge gas, both a material of this protection film and a film quality thereof may give great influences to the discharge characteristic. In general, magnesium oxide is employed as a protection film material. Magnesium oxide corresponds to such an insulating material having the superior anti-sputtering characteristic and the large secondary electron emission coefficient. In other words, since magnesium oxide is used, the discharge starting voltage is lowered, so that the surface discharge type PDP can be readily driven. Recently, a magnesium oxide film having a thickness of on the order of 1 $\mu$m is formed on a surface of the dielectric material layer by performing a vacuum vapor deposition while using magnesium oxide made in a pallet form as a starting material.

When the surface discharge type PDP is driven, a charge distribution over an entire screen is initialized (reset) during a time period defined after the sustain voltage application for a certain image is accomplished until a next image is addressed. Concretely speaking, prior to the addressing operation, reset pulses whose peak values exceed the discharge starting voltage are applied to the sustain electrode pairs of all of the lines. Since the reset pulses are applied, the surface discharge phenomenon will occur at front edges of these reset pulses, so that a large amount of wall electron charges are charged to the respective cells rather than that of the sustain voltage application. Subsequently, the self-discharge phenomenon will occur, which is caused only by the wall voltage in response to the rear edges of the reset pulses. As a result, the most wall charges are neutralized, and thus will disappear. In other words, the dielectric materials over the entire screen are brought into the substantially non-charged condition. Alternatively, another initialization may be carried out without such a self-discharge operation by that an erasing/discharge phenomenon occurs only in the cells which have been previously, selectively charged. In this alternative case, the addressing operation for this initialization is required, so that time required for switching displays would be prolonged.

Conventionally, there is another problem that a display is disturbed, called as a "black noise". The "black noise" is such a phenomenon that a cell to be lighted (namely, selected cell) could not be lighted. This black noise may easily occur in a boundary between a lighting region and a non-lighting region within a screen. It is not a fact that all of the plural selected cells contained in either one line or one column are not lighted. However, since the black noise occurrence portions appear in some places, the occurrence reason of this black noise may be understood as an address missing phenomenon. This address missing phenomenon is caused by that no address discharge operation is executed, or even when the address discharge operation is performed, the strength thereof is low.

The reason why the address missing phenomenon may be conceived by the residual wall charges in the reverse slit. In the case that the surface discharge operation is excessively spread by receiving the reset pulses and thus the wall charges are stored also in the reverse slit, even when the self-erasing discharge operation is subsequently performed, the wall charges present at the reverse slit located far from the discharge slit are left. The effective voltage of the addressing operation is lowered by this residual charge, so that the address missing phenomenon will occur. If the neighboring cells are the selected cells, since the space charges caused by the address discharge operations at the neighboring cells may contribute the priming effect, the address missing phenomenon can hardly occur. To the contrary, in the case that the neighboring cells (especially, front side of scanning) are the non-selected cells as in the above-described boundary, no priming effect may occur. Thus, the address missing phenomenon can hardly occur.

SUMMARY OF THE INVENTION

The present invention has been made to solve the above-described problems, and therefore has an object to reduce an occurrence ratio of a so-called "black noise" by providing the following plasma display panels.

The present invention provide a plasma display panel of a matrix display type, having a first electrode and a second electrode which constitute a main electrode pair, the first electrode and the second electrode being covered with an insulating layer against a discharge gas, wherein the insulating layer comprises a magnesium oxide film formed at least as a surface layer thereof which is in contact with the discharge gas, the magnesium oxide film having an impedance in the range of 230 to 330 kΩ/cm$^2$ at a frequency of 100 Hz.

Further, the present invention provide a plasma display panel of a matrix display type, having a first electrode and a second electrode which constitute a main electrode pair, the first electrode and the second electrode being covered with an insulating layer against a discharge gas, wherein the insulating layer comprises a magnesium oxide film formed at least as a surface layer thereof which is in contact with the discharge gas, the magnesium oxide film containing silicon atom or a compound thereof at an amount of 500 to 10,000 weight ppm.

Further, the present invention provide a plasma display device comprising: a plasma display panel of a matrix type, having a first electrode and a second electrode which constitute a main electrode pair and are formed on a same plane, a third electrode being formed so as to intersect with the first electrode and the second electrode, the first electrode and the second electrode being covered with an insulating layer against a discharge gas, wherein the insulating layer comprises a magnesium oxide film formed at least as a surface layer thereof which is in contact with the discharge gas, the magnesium oxide film having an impedance in the range of 230 to 330 KΩ/cm$^2$ at a frequency of 100 Hz, or containing silicon atom or a compound thereof at an amount of 500 to 10,000 weight ppm and a drive apparatus for applying a reset voltage between the first electrode and the second electrode during an initializing time period, applying an address voltage between the second electrode and the third electrode during an address time period, and applying a sustain voltage between the first electrode and the second electrode during a sustain time period, whereby both an addressing operation and a sustain operation are performed after a charging distribution of the entire screen has been initialized by self-erasing discharge.

Further, the present invention provide a substrate assembly for a plasma display panel, comprising;

a substrate;

a plurality surface-discharge electrodes on the substrate;

a dielectric layer covering the surface-discharge electrodes; and an insulating layer covering the dielectric layer, wherein the insulating layer comprises a magnesium oxide film formed as a surface layer thereof on a side which is to be in contact with a discharge gas, the magnesium oxide film having an impedance in the range of 230 to 330 kΩ/cm$^2$ at a frequency of 100 Hz, or containing silicon atom or a compound thereof at an amount of 500 to 10,000 weight ppm.

Further, the magnesium oxide film in accordance with the present invention is formed in such a manner that:

magnesium oxide in a pellet form is mixed with a starting material of an impurity in a pellet or powder form, and the mixture is heated at the same time;

a sintered member of a mixture of magnesium oxide in a powder form and a starting material of an impurity in a powder form is heated so as to be vapor-deposited; or a sintered member of a mixture of magnesium oxide in a powder form and a starting material of an impurity in a powder form is used as a target for sputtering, whereby the magnesium oxide film having an impedance in the range of 230 to 330 kΩ/cm$^2$ at a frequency of 100 Hz is formed, or the magnesium oxide film containing silicon atom or a compound thereof at amount of 500 to 10,000 weight ppm is formed.

DETAILED DESCRIPTION OF THE PREFERRED EMBODIMENTS

Figure 1:
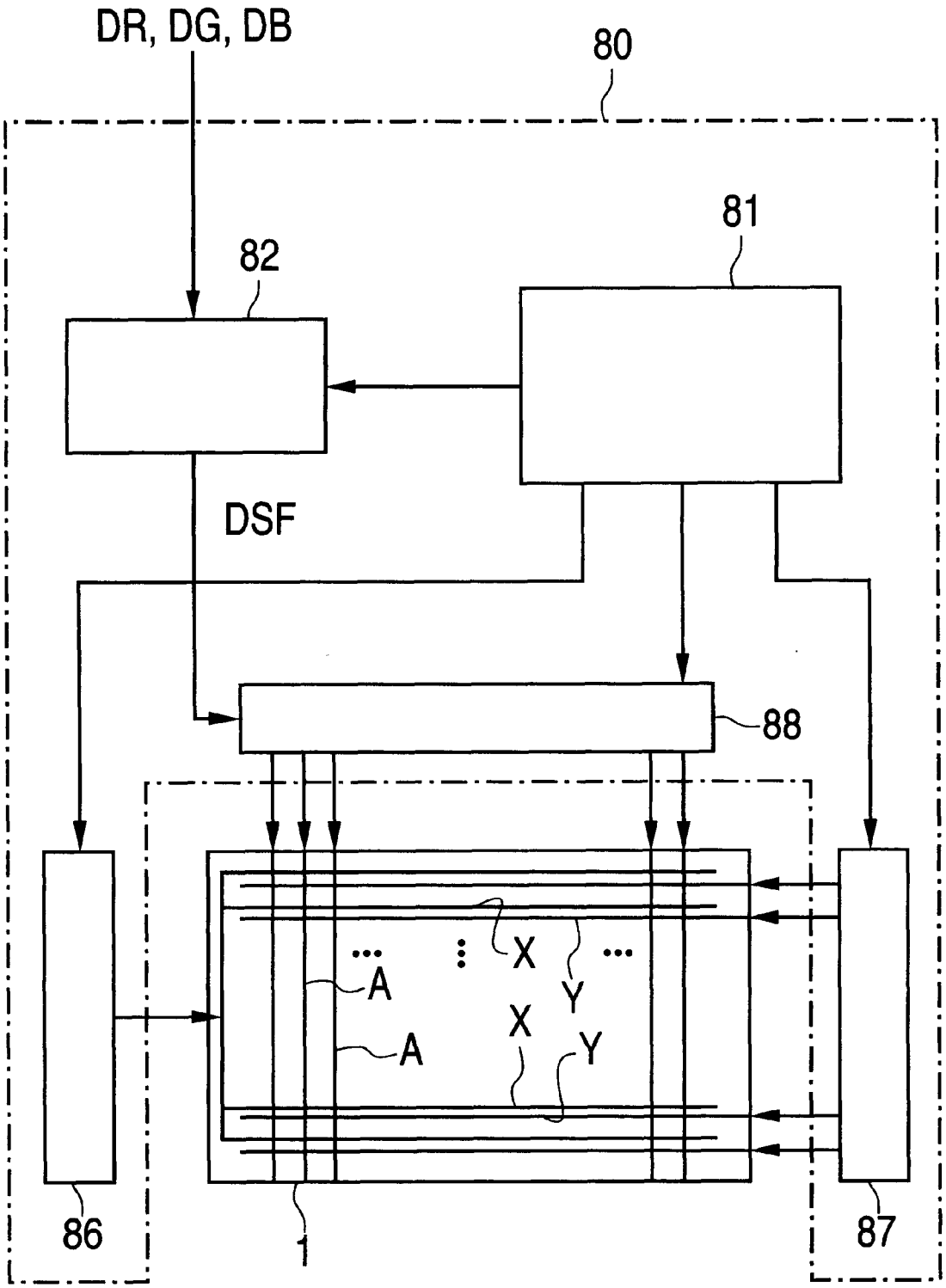
FIG. 1 is a schematic block diagram for representing a structure of a plasma display device (PDP) according to the present invention.

As previously described, the object of the present invention is to reduce the occurrence ratio of a so-called "black noise", namely cells to be lighted cannot be lighted, and further to improve display qualities of a PDP (plasma display panel). To achieve this object, the PDP of the present invention is featured by comprising such a structure that a surface to be in contact with discharge gas, typically a surface of a dielectric layer for electrodes is covered by a magnesium oxide film having a specific film quality. With employment of this structure, a discharge characteristic of the PDP can be improved.

The film quality of the magnesium oxide film will depend upon a film forming condition containing a composition of a starting material. The following recognition could be made. The occurrence ratio (degree) of the so-called "black noise" surely depended upon comparison results with respect to manufacturing lots. To specify electrical characteristics, impedances were measured. The reason why the impedances are measured is such that it is very difficult to correctly measure a DC resistance value of an insulating material.

The following results have been obtained. That is, when the impedance value is present within a predetermined range, the occurrence degree of the black noise is low, whereas even when the impedance value is smaller, or larger than a value within the predetermined range, the occurrence degree of the black noise is high.

Also, the composition analysis of the magnesium oxide has been carried out. In the case that the contained amount of silicon (Si) atom is present within a predetermined range, the occurrence degree of the black noise is low. As to boron (B) atom, carbon (C) atom and calcium (Ca) atom, there is no particular difference between a sample having a high occurrence ratio of the black noise, and a sample having a low occurrence ratio of the black noise. It could be predicted that such an element whose balance is larger than (more than, or equal to 3) that of magnesium as same as silicon represented similar effects as silicon atom, in particular, elements in the 3a group or 4a group, the ion radius of which is close to that of magnesium.

In this specification, a "predetermined range" implies a range defined from 230 kΩ/cm to 330 kΩ/cm.

It is preferable that the magnesium oxide film contains either an element whose balance is larger than, or equal to 3, or a compound thereof as an impurity. The impurity may be selected from silicon atom, aluminum atom, or a compound of these elements. Either silicon atom or its compound such as silicon oxide is preferably contained in the magnesium oxide film within a range of 500 to 10,000 weight ppm.

Further, the reason why the address missing phenomenon for causing the black noise can be suppressed may be given as follows: that is, projection amounts of secondary electrons are increased, so that lowering of an effective voltage caused by residual charges can be compensated: and the residual effect of electron charges can be reduced, and the residual charges can quickly disappear.

Next, a description will now be made of a method for manufacturing the magnesium oxide film.

As the starting material of the magnesium oxide film, magnesium oxide formed in either a pellet or powder may be employed. In such a case that an impurity is contained in this magnesium oxide film, a starting material of this impurity may be formed in either a pellet or powder.

The magnesium oxide film may be manufactured by employing the above-described starting material by way of either the vapor depositing method or the sputtering method, as exemplified as follows.

(1) In a vapor deposition method, magnesium oxide formed in a pellet is mixed with the starting material of the impurity formed in a pellet or powder, and these starting materials are heated at the same time so as to be vapor-deposited.

(2) In another vapor deposition method, a sintered member is made of a mixture between magnesium oxide formed in powder and the starting material of the impurity formed in powder is heated so as to be vapor-deposited.

(3) In a sputtering method, a sintered member is made of a mixture between magnesium oxide formed in power and the starting material of the impurity formed in powder, and this sintered member is used as a target for sputtering.

It should be noted that in accordance with the present invention, not only the PDP, but also a substrate assembly used for the PDP can be provided. The substrate assembly used for the PDP according to the present invention implies that for instance, in case of a surface discharged type PDP, the substrate assembly provided on the display side.

Also, a structure of an electrode employed in the PDP of the present invention may be arranged by a first electrode and a second electrode, which constitute a main electrode pair (a surface-discharge electrodes) formed on the same plane, usually a same substrate, and further a third electrode which intersects with the first electrode and the second electrode. It should also be noted that the third electrode may be used as a so-called "address electrode" to which an address voltage is applied.

Further, in accordance with the present invention, the plasma display device may be provided which is constructed of the above-described PDP and a drive apparatus thereof.

Although the present invention is not limited to the below-mentioned drive apparatus, such a drive apparatus may be provided in which a reset voltage is applied between the first electrode and the second electrode during an initializing time period, an address voltage is applied between the second electrode and the third electrode during an address time period, and a sustain voltage is applied between the first electrode and the second electrode during a sustain time period. As a consequence, after the charging distribution of the entire screen has been initialized by self-erasing discharge, both addressing operation and sustain operation can be performed.

FIG. 1 is a schematic block diagram for showing a plasma display device 100 according to the present invention.

The plasma display device 100 is arranged by an AC type PDP 1 functioning as a matrix type color display device and a drive unit 80 for selectively lighting a large number of cells which constitute a display screen. This plasma display device 100 may be used as a wall-mounted type television, and a monitor of a computer system.

The AC type PDP 1 is a surface discharge type PDP in which one pair of sustain electrodes X and Y (the first electrode and the second electrode) are arranged in parallel to each other. Each of cells in this PDP 1 owns an electrode matrix having a three-electrode structure corresponding to the sustain electrodes X, Y and the address electrode (third electrode). The sustain electrodes X and Y extend along a line direction (horizontal direction) of the screen, and one sustain electrode Y is employed as a scan electrode for selecting cells in unit of a line when an addressing operation is performed. The address electrode "A" is a data electrode for selecting cells in unit of a column, and extends along a column direction (vertical direction).

The drive unit 80 contains a controller 81, a frame memory 82, an X-driver circuit 86, a Y-driver circuit 87, an address driver circuit 88, and a power supply circuit (not shown in detail). To this drive unit 80, picture (video) data DR, DG, DB having multiple values, which indicate luminance levels (gradation levels) of R, G, B signals for each pixel are supplied from an external apparatus in combination with various sorts of synchronization (sync) signals. The picture data DR, DG, DB are once stored into the frame memory 82, and then are converted into sub-frame data "Dsf" every color by the controller 81. These sub-frame data Dsf are again stored into the frame memory 82. This sub-frame data Dsf corresponds to a set of binary data for indicating whether or not the cells are required to be lighted in the respective sub-frames produced by subdividing 1 frame in order to display gradation. The X-driver circuit 86 has a function to apply a voltage to the sustain electrode X, and the Y-driver circuit 87 owns a function to apply a voltage to the sustain electrode Y. The address driver circuit 88 selectively applies an address voltage to the address electrode A in response to the sub-frame data Dsf transferred from the frame memory 82.

Next, a description will now be made of a driving method applicable to this PDP 1.

Figure 2:
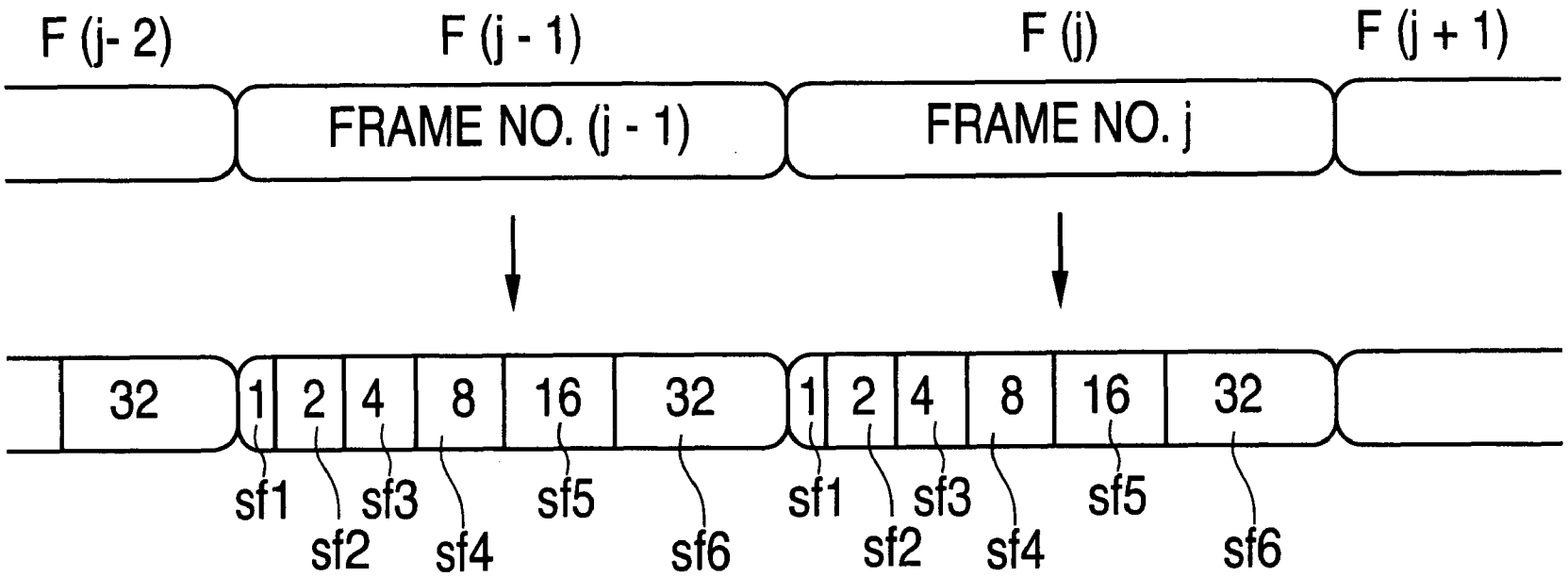
FIG. 2 schematically illustrates a frame division used in the PDP of FIG. 1.
Figure 3:
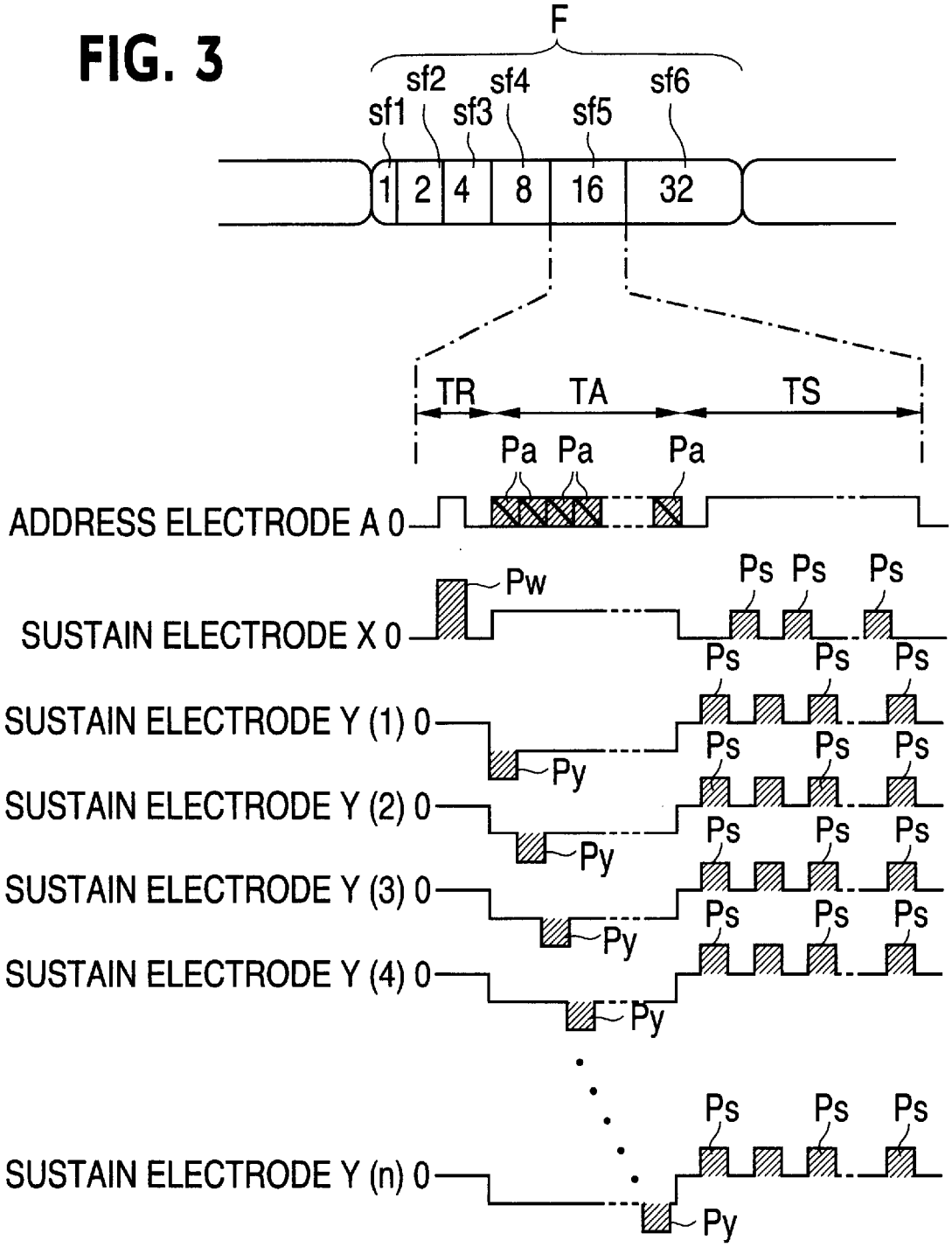
FIG. 3 illustratively represents a voltage waveform diagram for describing a drive sequence of the PDP shown in FIG. 1.

FIG. 2 schematically represents a frame division, and FIG. 3 is a voltage waveform diagram for indicating a drive sequence.

To reproduce gradation by binary-controlling emissions of cells, a time sequence of frames "F" corresponding to an externally inputted image is subdivided into, for instance, 6 pieces of sub-frames sf1, sf2, sf3, sf4, sf5, and sf6. A relative ratio of illuminance in the respective sub-frames sf1 to sf6 is set to be equal to 1:2:4:8:16:32, so that the emitting number of the sustain electrodes for the respective sub-frames sf1 to sf6 may be set. Since 64 luminance step levels "0" to "63" can be set with respect to each of the R, G, B colors by combining ON/OFF operations of emissions in unit of the sub-frame, a total number of displayable colors becomes $64^3$. It should be understood that there is no need to display these sub-frames sf1 to sf6 in a sequence of the relative ratio of luminance. For example, the subframe sf6 having the large relative ratio may be arranged at an intermediate portion of the display period so as to realize optimization.

As indicated in FIG. 3, with respect to each of the sub-frames sf1 to sf6, a reset time period "TR", an address time period "TA", and a sustain time period "TS" are allocated. The lengths of the reset time period TR and the address time period TA are made constant irrelevant to the relative ratio of luminance, whereas the larger the relative ratio of luminance becomes, the larger the length of the sustain time period TS becomes. In other words, the lengths of the display time periods of the respective sub-frames sf1 to sf6 are different from each other.

The reset time period TR corresponds to a time period during which wall charges of an entire screen are erased (initialized) in order to prevent an adverse influence caused by a lighting state of the preceding operation. A reset pulse "Pw" having a positive polarity, the peak value of which exceeds the surface discharge starting voltage, is applied to the sustain electrodes X of all of the lines (line numbers being "n"), and at the same time, a pulse having a positive polarity is applied to all of the address electrodes A in order to avoid charging on the rear surface and ion bombardment. In response to a rising portion of the reset pulse Pw, the strong surface discharge will occur in all of the lines, so that a large amount of wall electron charges are produced in the cell. The applied voltage is canceled by this wall voltage, so that the effective voltage is lowered. When the reset pulse Pw rises, the wall voltage directly becomes the effective voltage, so that the self-discharge phenomenon will occur. The most wall change at all of the walls may disappear, and thus the overall screen is brought into a uniform non-charged condition.

The address time period TA corresponds to a time period of an addressing operation (namely, setting of lighting/non-lighting). The sustain electrode X is biased to be a positive potential with respect to the ground potential, and all of the sustain electrodes Y are biased to be a negative potential. Under this condition, the respective lines are sequentially selected from a top line to a last line every 1 line, and then a scan pulse "Py" having a negative polarity is applied to the relevant sustain electrode Y. When the lines are selected, at the same time, an address pulse "Pa" having a positive polarity is applied to such the address electrode A corresponding to a cell which is indicated by the sub-frame data Dsf and should be lighted. In the selected line, a counter discharge will occur between the sustain electrode Y and the address electrode A at the cell, to which the address pulse Pa is applied, and then this counter discharge is advanced to a surface discharge. A series of the above-described discharge operations corresponds to an address discharge operation. Since the sustain electrode X is biased at the potential having the same polarity as that of the address pulse Pa, the address pulse Pa is canceled by this biassing potential, so that no discharge operation can be produced between the sustain electrode X and the address electrode A.

The sustain time period TS corresponds to a time period during which a preset lighting state is maintained so as to secure luminance in response to a gradation level. To prevent unnecessary discharge operation, all of the address electrodes A are biased to a potential of a positive polarity, and a sustain pulse Ps having a positive polarity is applied to all of the sustain electrodes Y in the beginning. Thereafter, the sustain pulse Ps is alternately applied to the sustain electrode X and the sustain electrode Y, the surface discharge will occur at the cells where the wall charges are stored during the address time period TA every time the sustain pulse Ps is applied. The application time period of the sustain pulse Ps is constant, and the sustain pulses Ps are applied, the number of which is set based upon the relative ratio of the luminance.

Figure 4:
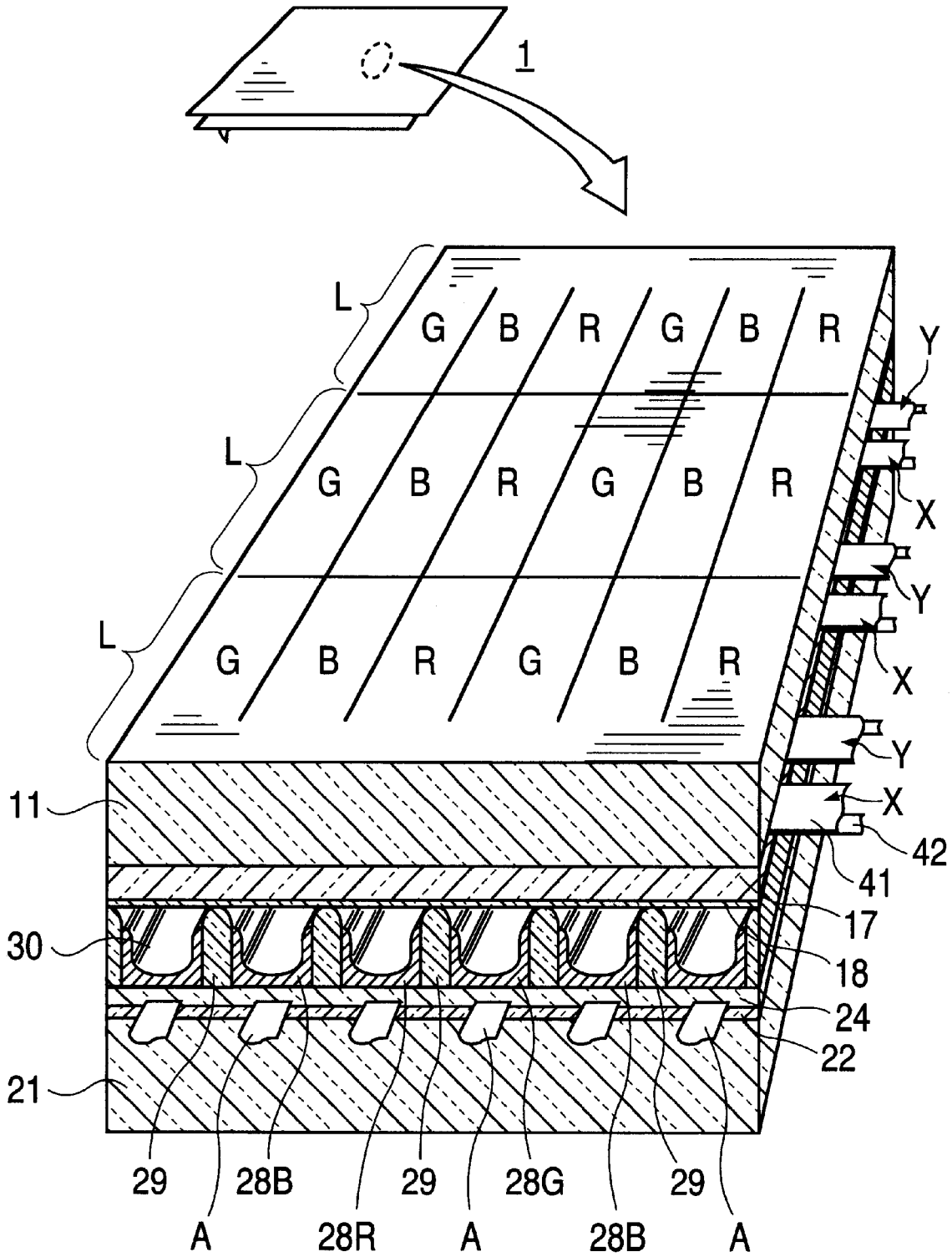
FIG. 4 is a perspective view for representing an internal structure of the PDP according to the present invention.

FIG. 4 is a perspective view for illustrating an internal structure of the PDP 1 according to the present invention.

In this PDP 1, one-paired sustain electrodes X and Y are arrayed every a line L corresponding to a cell column of a screen along a horizontal direction on an inner surface of a glass board 11 provided on a front surface side among a board pair for sandwiching discharge space 30. Each of the sustain electrodes X and Y is made of a metal film 42 in order to reduce a resistance value in combination with a transparent conductive film 41, and is covered with the dielectric layer 17 for an AC drive purpose. A material of the dielectric layer 17 is a PbO group low melting point glass (dielectric constant is approximately 10). The magnesium oxide film 18 (a film quality of the film 12 will be discussed later) is coated as a protection film on a surface of the dielectric layer 17. A thickness of this magnesium oxide film 18 is 5000~9000 Å, e.g. approximately 7,000 Å. Both the dielectric layer 17 and the magnesium oxide film 18 own light transmission characteristics. It should be noted that a board on which a stacked layer member constructed of sustain electrodes, the dielectric layer, and the protection film may be referred to as a board for a plasma display panel. An under base layer 22, the address electrode A, the insulating layer 24, an isolation wall 29, and three colors (R, G, B) fluorescent material layers 28R, 28G, 28B for color display are formed on an inner surface of the glass board 21 provided on the rear surface side. Each of the isolation walls 29 is made of a straight line form, while observing on a flat surface. The discharge space 30 is segmented by these isolation walls 29 every sub-pixel (namely, unit light emitting region) along the line direction, and further an interval between the adjoining discharge space 30 is defined as a predetermined value (about 150 $\mu$m). A discharge gas made by mixing a very small amount of xenon with neon is filled into the discharge space 30. The fluorescent material layers 28R, 28G, 28B are locally excited by ultraviolet rays produced during discharge operation to emit visible light having preselected colors.

A single display pixel is arranged by three sub-pixels arrayed along the line direction. A structural member within a range of the respective sub-pixels corresponds to the cell. Since an arranged pattern of the barrier ribs 29 is a stripe pattern, portions among the discharge space 30, which correspond to the respective columns, are continued along the column direction under such a condition that these portions bridge all lines. The colors emitted from the sub-pixels within the respective columns are equal to each other.

The PDP 1 of the above-described structure is manufactured by carrying out a series of the below-mentioned manufacturing steps. That is, a predetermined structural element is separately provided on each of the glass boards 11 and 21 to thereby form substrate assemblys for a front surface and a rear surface. Both the substrate assemblys are overlapped with each other at a predetermined interval, peripheral portions of the interval are sealed, air in the interval is exhausted, and the discharge gas is filled into the interval. While the substrate assembly for the front surface is manufactured, the magnesium oxide film 18 is formed under such a selected condition that the film quality capable of effectively reducing the black noise can be obtained.

Now, a description will be made of the film quality of the magnesium oxide film 18.

Figure 5A:
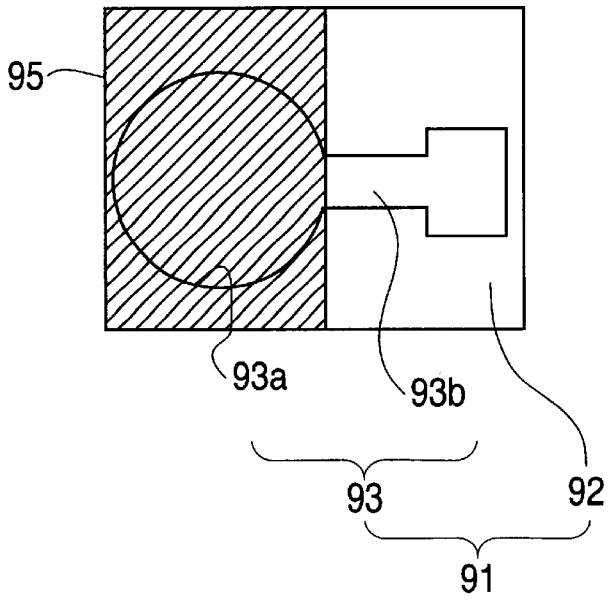
FIG. 5A and FIG. 5B illustrate a method for measuring an impedance.
Figure 5B:
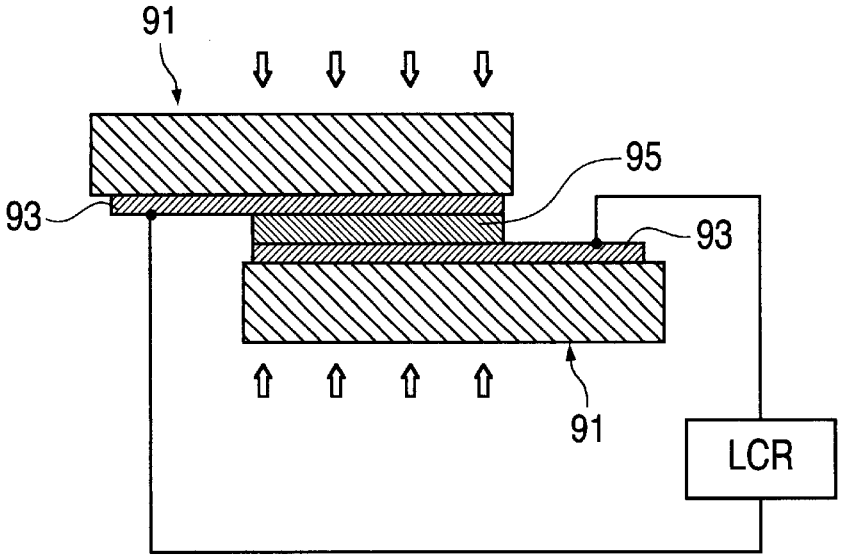
Figure 6:
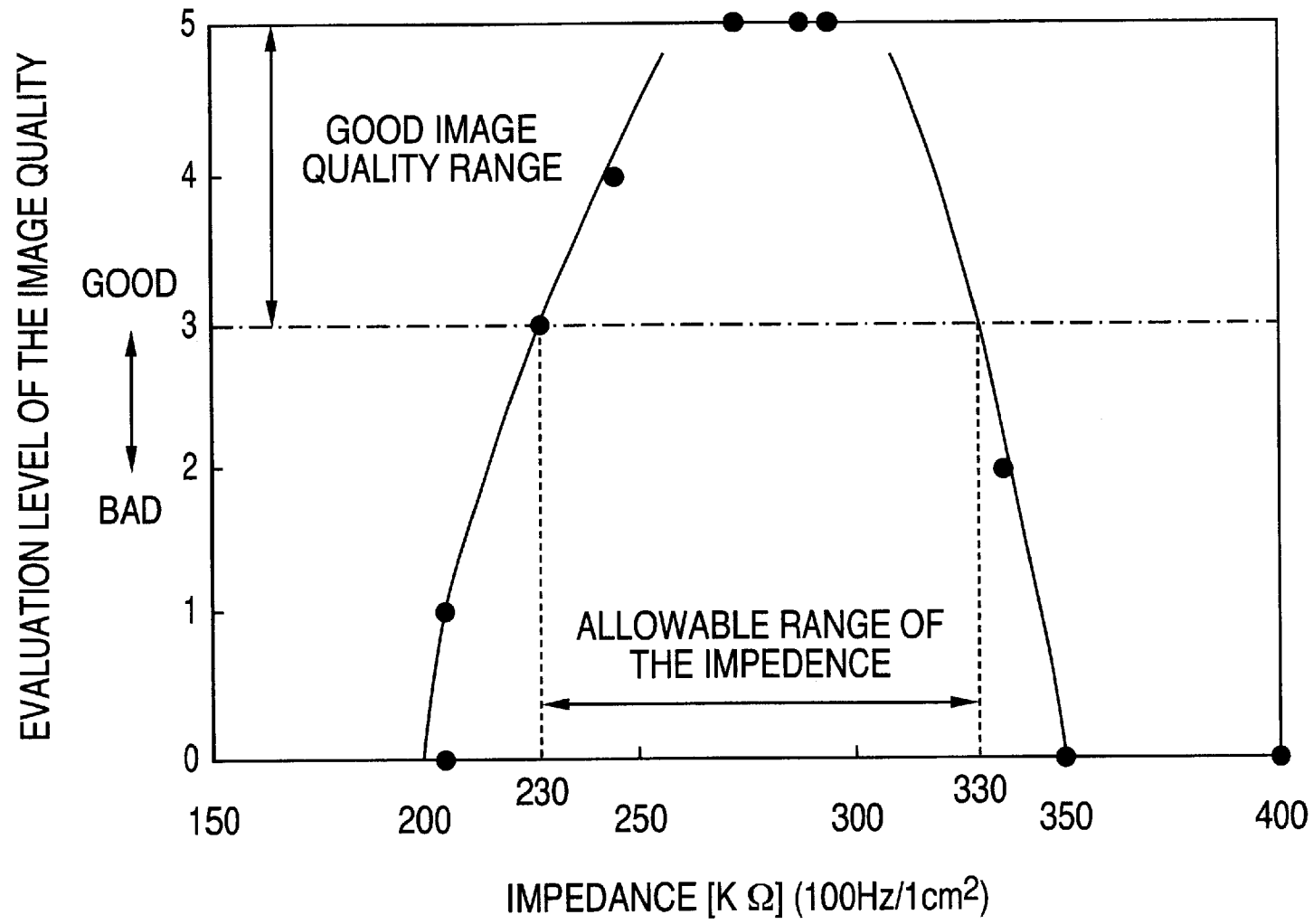
FIG. 6 is a graphic representation between the impedance of the magnesium oxide film and the image quality.

FIG. 5A and FIG. 5B illustratively show a method for measuring an impedance. FIG. 6 is a graphic representation of a relationship between an impedance of a magnesium oxide film and an image quality.

First, a plurality of electrode boards are prepared. Magnesium oxide films were formed on the surfaces of these electrode boards under different film forming conditions. As indicated in FIG. 5A, the electrode board 91 is manufactured in such a manner that a conductive film 93 constituted by an electrode portion 93*a* having a diameter of 20 mm and a conducting portion 93*b* is formed on a surface of glass plate 92 with a size of 50 mm×60 mm. A material of the conductive film 93 is selected to be ITO which is the same as the transparent conductive film 41 for constituting the sustain electrodes X and Y. After the magnesium oxide film 95 having a thickness of approximately 7,000 Å was formed in such a manner that the entire portion of the electrode portion 93*a* could be uniformly covered, as represented in FIG. 5B, another electrode board 91 was overlapped, and then the magnesium oxide film 95 was sandwiched by employing one pair of conductive films 93. Subsequently, an impedance of the resultant magnesium oxide film 95 was measured by using an LCR meter. The measuring conditions were given as follows: the weight for sandwiching the magnesium oxide film 95 was 7 kg/cm$^2$; the applied voltage was 1 V (effective value), and the frequency was 100 Hz.

On the other hand, a plurality of samples were measured impedances, and at the same time, an image quality of the PDP on which the magnesium oxide film 18 has been formed was evaluated. This evaluation was carried out by way of an observation investigation while displaying a transverse stripe pattern in which lighting line groups and non-lighting line groups were alternately arranged every several tens of lines. A luminance level of the lighting line group was made equal to a half of a maximum luminance level, namely about "32". The back noise was remarkable by lighting only the sub-frames sf6 whose relative rate was "32". If the number of sub-frame to be lighted is equal to 1, then one address missing phenomenon may appear as the entire frame is lighted. Also, when the luminance level is equal to "32", there is a large luminance difference in such a case that a frame is correctly lighted, and is not correctly lighted. When the respective lines are sequentially selected from the headline to the last line to perform the addressing operation in the above-described manner, the back noise may readily occur at a line located at the nearest position with respect to the head line of each of the lighting line groups. It should be noted that since the address missing phenomenon does not always occur, the black noise can be recognized as the flicker phenomenon in the light emission.

As to image qualities of the respective PDPs manufactured as a sample, the evaluation was carried out at six stages shown in a table 1 so as to investigate a relationship between impedances and image qualities.

TABLE 1

Evaluation Level/Flickering Degree 5 (best)—no flicker
4—flicker intermittently occurs in several cells
3—flicker substantially normally occurs in several cells
2—flicker normally occurs in most of cells in 1 line
1—flicker normally occurs in most of cells in 2 lines
0 (worst)—flicker normally occurs in most of cells in more than 3 lines As apparent from the graphic representation shown in FIG. 6, the best image quality can be obtained in a range that the impedance per 1 cm$^2$ is 270 to 300 kΩ. Conversely, the image qualities are deteriorated when the impedance is lowered from this range, and also increased from this range. When the image quality becomes lower than the evaluation level 2, the characters can be hardly read. However, when the image quality becomes higher than the evaluation level 3, there is no practical problem. In other words, the allowable range of the impedance corresponding to the good image quality range is 230 to 330 kΩ.

Figure 7:
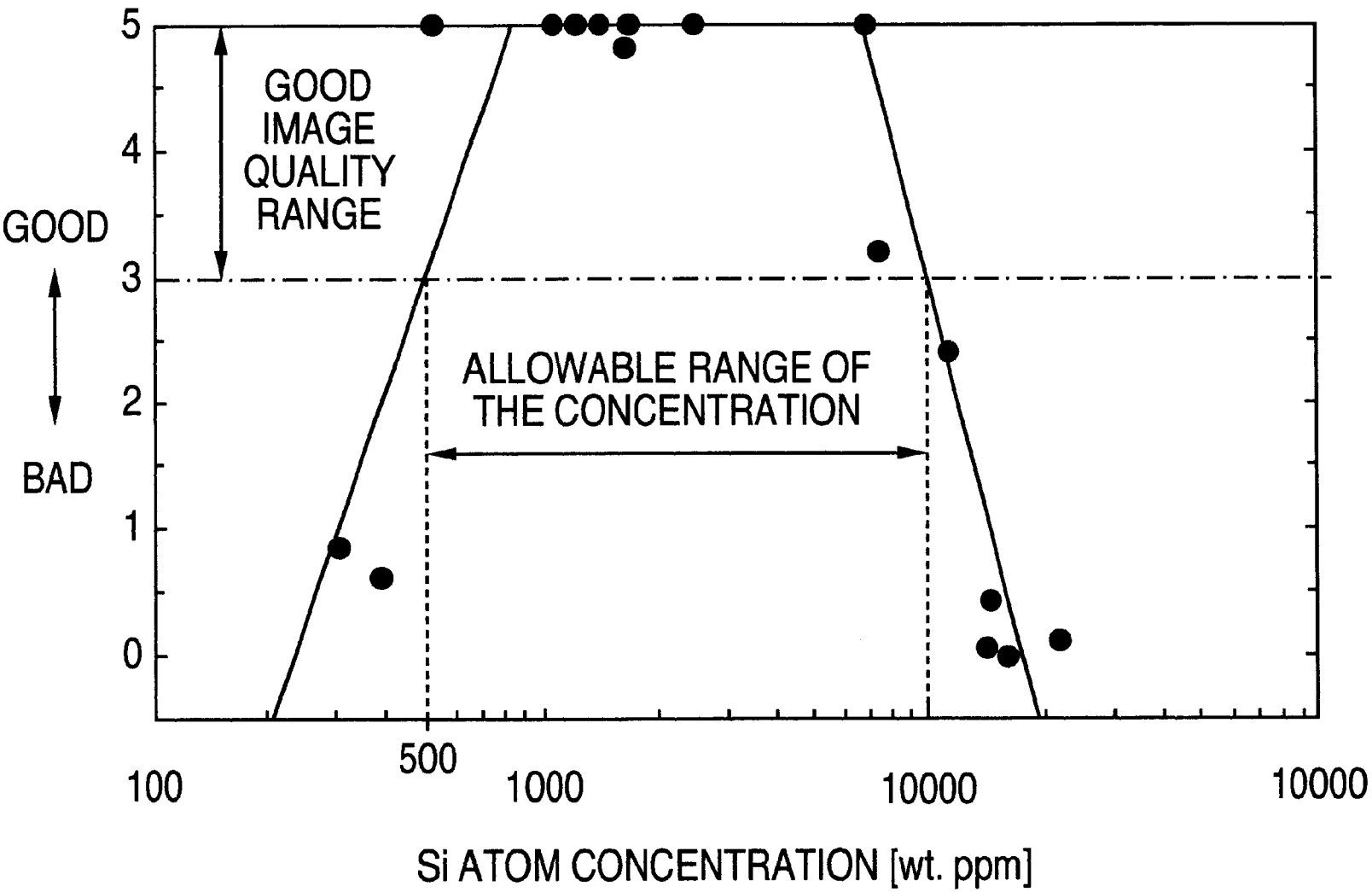
FIG. 7 is a graphic representation between a contained amount of silicon and the image quality.

FIG. 7 is a graphic representation for showing a relationship between an image quality and a contained amount of silicon.

A sample was manufactured by forming the magnesium oxide film on a tantalum board. The investigation was made of compositions of the magnesium oxide film with respect to a region of a plane area of 450 cm$^2$ by way of the emission analysis method (ICP method). When the magnesium oxide film was formed on the tantalum board, at the same time, the magnesium oxide film 18 was formed, so that the PDP was manufactured as the sample. The image qualities of the sample PDPs were evaluated in a similar evaluation manner to the above-described evaluation manner. As represented in FIG. 7, an allowable range of silicon atom concentration corresponding to a good image quality range is 500 to 10,000 weight ppm, and the best image quality can be obtained in a range of 1,000 to 8,000 weight ppm. It should be noted that a substantially similar result to the sample analysis by the ICP method could be obtained when the compositions of the magnesium oxide films formed on each of the sample PDPs were investigated by the secondary ion mass spectrometry (SIMS).

The magnesium oxide film 18 containing a proper amount of silicon atom could be obtained by using the vacuum vapor deposition. When the film is formed, magnesium oxide in a pellet and a silicon compound (silicon oxide, silicon monoxide) in a pellet or powder are mixed and the mixture is used as a vapor deposition source. For instance, the magnesium oxide film 18 having the silicon atom concentration of 1,400 weight ppm corresponding to the best evaluation level 5 could be obtained in accordance with the following conditions. That is, a material was used which was made by mixing the silicon oxide powder in the ratio of 0.1 weight % with the magnesium oxide pellet whose grain diameter was 5 to 3 mm and whose purity was higher than, or equal to 99.95%. The magnesium oxide film 18 was manufactured under film, forming conditions that the vacuum degree was $5\times10^{-5}$ Torr; the oxygen conduction flow rate was 12 sccm; the oxygen partial pressure was higher than, or equal to 90%; the rate was 20 Å/sec; the film thickness was 7,000 Å; and the board temperature was 150° C. by way of the reactive EB vapor deposition method where the pierce type gun was employed as the heat source. Alternatively, a sintered member of a mixture made from magnesium oxide and the silicon compound may be employed as the vapor deposition source. Also, while a similar sintered member may be used as a target in the sputtering operation, a desirable magnesium oxide film 18 may be formed.

In accordance with the present invention, the occurrence ratio of the black noise (namely, a phenomenon that a cell to be lighted could not be lighted) can reduced, so that the display quality can be improved.

What is claimed is:

1. A plasma display panel having a first electrode and a second electrode which constitute a main electrode pair, the first electrode and the second electrode being covered with an insulating layer against a discharge gas, wherein the insulating layer comprises a magnesium oxide film formed at least as a surface layer thereof which is in contact with the discharge gas, the magnesium oxide film having an impedance in the range of 230 to 330 kΩ/cm$^2$ at a frequency of 100 Hz.

2. A plasma display panel as set forth in claim 1, wherein the magnesium oxide film contains as an impurity an element whose valence is more than or equal to 3 and its ion radius is closed to that of magnesium, or a compound thereof.

3. A plasma display panel as set forth in claim 2, wherein the plasma display panel is a matrix display type plasma display panel.

4. A plasma display panel as set forth in claim 1, wherein the magnesium oxide film includes an impurity which is silicon atom, aluminum atom or a compound thereof.

5. A plasma display panel as set forth in claim 4, wherein the plasma display panel is a matrix display type plasma display panel.

6. A plasma display panel as set forth in claim 1, wherein the magnesium oxide film includes an impurity which is silicon atom or a compound thereof at an amount of 500 to 10,000 ppm in the magnesium oxide film.

7. A plasma display panel as set forth in claim 6, wherein the plasma display panel is a matrix display type plasma display panel.

8. As plasma display panel as set forth in claim 6, wherein the silicon compound is silicon oxide.

9. A plasma display panel as set forth in claim 8, wherein the plasma display panel is a matrix display type plasma display panel.

10. As plasma display panel as set forth in claim 1, wherein the magnesium oxide film has a thickness of 5000~9000 Å.

11. A plasma display panel as set forth in claim 10, wherein the plasma display panel is a matrix display type plasma display panel.

12. A plasma display panel as set forth in claim 1, wherein the plasma display panel is a matrix display type plasma display panel.

13. A plasma display panel having a first electrode and a second electrode which constitute a main electrode pair, the first electrode and the second electrode being covered with an insulating layer against a discharge gas, wherein the insulating layer comprises a magnesium oxide film formed at least as a surface layer thereof which is in contact with the discharge gas, the magnesium oxide film containing silicon atom or a compound thereof at an amount of 500 to 10,000 weight ppm.

14. As plasma display panel as set forth in claim 13, wherein the magnesium oxide film has a thickness of 5000~9000 Å.

15. A plasma display panel as set forth in claim 14, wherein the magnesium oxide film is manufactured by a vapor depositing method.

16. A plasma display panel as set forth in claim 14, wherein the plasma display panel is a matrix display type plasma display panel.

17. A plasma display panel as set forth in claim 13, wherein the plasma display panel is a matrix display type plasma display panel.

18. A plasma display panel as set forth in claim 13, wherein the magnesium oxide film is manufactured by a vapor depositing method.

19. A plasma display device comprising:

a plasma display panel having a first electrode and a second electrode which constitute a main electrode pair and are formed on a same plane, a third electrode being formed so as to intersect with the first electrode and the second electrode, the first electrode and the second electrode being covered with an insulating layer against a discharge gas, wherein the insulating layer comprises a magnesium oxide film formed at least as a surface layer thereof which is in contact with the discharge gas, the magnesium oxide film having an impedance in the range of 230 to 330 KΩ/cm$^2$ at a frequency of 100 Hz, or containing silicon atom or a compound thereof at an amount of 500 to 10,000 weight ppm; and a drive apparatus for applying a reset voltage between the first electrode and the second electrode during an initializing time period, applying an address voltage between the second electrode and the third electrode during an address time period, and applying a sustain voltage between the first electrode and the second electrode during a sustain time period, whereby both an addressing operation and a sustain operation are performed after a charging distribution of the entire screen has been initialized by self-erasing discharge.

20. A plasma display device as set forth in claim 19, wherein the plasma display panel is a matrix display type plasma display panel.

21. A substrate assembly for a plasma display panel, comprising:

a substrate;

a plurality surface-discharge electrodes on the substrate;

a dielectric layer covering the surface-discharge electrodes; and an insulating layer covering the dielectric layer, wherein the insulating layer comprises a magnesium oxide film formed as a surface layer thereof on a side which is to be in contact with a discharge gas, the magnesium oxide film having an impedance in the range of 230 to 330 kΩ/cm$^2$ at a frequency of 100 Hz.

22. A substrate assembly for a plasma display panel, comprising:

a substrate;

a plurality surface-discharge electrodes on the substrate;

a dielectric layer covering the surface-discharge electrodes; and an insulating layer covering the dielectric layer, wherein the insulating layer comprises a magnesium oxide film formed as a surface layer thereof on a side which is to be in contact with a discharge gas, the magnesium oxide film containing silicon atom or a compound thereof at an amount of 500 to 10,000 weight ppm.

23. A substrate assembly as set forth in claim 22, wherein the magnesium oxide film includes an impurity which is silicon atom, aluminum atom or a compound thereof.

24. A substrate assembly as set forth in claim 22, wherein the magnesium oxide film includes an impurity which is silicon atom or a compound thereof at an amount of 500 to 10,000 ppm in the magnesium oxide film.

25. A substrate assembly as set forth in claim 22, wherein the magnesium oxide film is manufactured by a vapor depositing method.

26. A method of manufacturing a plasma display panel having:

a first electrode and a second electrode constituting a main electrode pair; and an insulating layer covering the first electrode and the second electrode so as to prevent the first and second electrodes from being in contact with a discharge gas, the insulating layer comprising a magnesium oxide film formed as a surface layer thereof on a side which is to be in contact with a discharge gas, wherein the magnesium oxide film is formed in such a manner that:

magnesium oxide in a pellet form is mixed with a starting material of an impurity in a pellet or powder form, and the mixture is heated at the same time;

a sintered member of a mixture of magnesium oxide in a powder form and a starting material of an impurity in a powder form is heated so as to be vapor-deposited; or a sintered member of a mixture of magnesium oxide in a powder form and a starting material of an impurity in a powder form is used as a target for sputtering, whereby the magnesium oxide film having an impedance in the range of 230 to 330 $k\Omega/cm^2$ at a frequency of 100 Hz is formed.

27. A method as set forth in claim 26, wherein the magnesium oxide film includes an impurity which is silicon atom, aluminum atom or a compound thereof.

28. A method as set forth in claim 26, wherein the magnesium oxide film includes an impurity which is silicon atom or a compound thereof at an amount of 500 to 10,000 ppm in the magnesium oxide film.

29. A method of manufacturing a plasma display panel having:

a first electrode and a second electrode constituting a main electrode pair; and an insulating layer covering the first electrode and the second electrode so as to prevent the first and second electrodes from being in contact with a discharge gas, the insulating layer comprising a magnesium oxide film formed as a surface layer thereof on a side which is to be in contact with a discharge gas, wherein the magnesium oxide film is formed in such a manner that:

magnesium oxide in a pellet form is mixed with a starting material of silicon or a compound thereof in a pellet or powder form, and the mixture is heated at the same time;

a sintered member of a mixture of magnesium oxide in a powder form and a starting material of silicon or a compound thereof in a powder form is heated so as to be vapor-deposited; or a sintered member of a mixture of magnesium oxide in a powder form and a starting material of silicon or a compound thereof in a powder form is used as a target for sputtering, whereby the magnesium oxide film containing silicon atom or a compound thereof at an amount of 500 to 10,000 weight ppm is formed.

* * * * *